United States Patent [19]

Kochte et al.

[11] Patent Number: 4,573,237

[45] Date of Patent: Mar. 4, 1986

[54] HAND VACUUM WITH TILTING INTAKE

[75] Inventors: Werner W. Kochte, Ravenna; Susan K. Nimon, Cuyahoga Falls, both of Ohio

[73] Assignee: The Scott & Fetzer Company, Westlake, Ohio

[21] Appl. No.: 598,838

[22] Filed: Apr. 10, 1984

[51] Int. Cl.[4] ..... A47L 5/24

[52] U.S. Cl. ..... 15/344; 15/354; 15/414; 15/415 R

[58] Field of Search ..... 15/338, 344, 354, 355, 15/356, 357, 358, 359, 360, 373, 397, 414, 415 R, 416, 417

[56] References Cited

U.S. PATENT DOCUMENTS

| | | | |
|---|---|---|---|
| 993,202 | 5/1911 | Russell et al. . | |
| 1,050,989 | 1/1913 | Niuffer . | |
| 1,140,992 | 5/1915 | Martin | 15/338 |
| 1,946,585 | 2/1934 | Leathers . | |
| 1,950,450 | 3/1934 | Leathers . | |
| 2,187,164 | 1/1940 | Leathers . | |
| 2,190,329 | 2/1940 | Leathers . | |
| 2,216,275 | 10/1940 | Kroenlein . | |
| 2,278,096 | 3/1942 | Ross . | |
| 3,513,500 | 5/1970 | Hori . | |
| 3,894,308 | 7/1975 | Carr | 15/397 |
| 4,100,644 | 7/1978 | Johansson | 15/397 |
| 4,175,352 | 11/1979 | Catlett | 15/344 X |
| 4,209,875 | 7/1980 | Pugh | 15/344 |
| 4,219,900 | 9/1980 | Dyer | 15/339 |
| 4,336,628 | 6/1982 | Bradshaw et al. | 15/415 R |

*Primary Examiner*—Chris K. Moore

*Attorney, Agent, or Firm*—Pearne, Gordon, Sessions, McCoy, Granger & Tilberry

[57] ABSTRACT

A hand held vacuum cleaner of the type having a detachable dust cup is provided with a tiltable nozzle at the intake or forward end of the dust cup.

22 Claims, 12 Drawing Figures

HAND VACUUM WITH TILTING INTAKE

BACKGROUND OF THE INVENTION

This invention relates to compact hand held vacuum cleaners of the type in which a replaceable filter bag is mounted with its closed end extending in the upstream direction of airflow within a tapered hood or "dust cup," the vacuum nozzle for the cleaner being at the intake end of the dust cup and the dust cup being detachable from the remainder of the cleaner for emptying from its large rearward or downstream end. Such cleaners are also provided with a flap valve associated with the vacuum nozzle to prevent dirt from falling out of the dust cup if power is turned off with the cleaner pointed downwardly—the normal attitude during use.

Hand held vacuum cleaners of the foregoing dust cup type have previously been provided, and have gained wide market acceptance. Earlier units had separate nozzle structure outside the upstream end of the dust cup, as in U.S. Pat. No. 3,513,500. Later units had a nozzle located at the upstream or forward end of the dust cup itself, as in U.S. Pat. No. 4,209,875, with the tapering of the dust cup extending all the way to the relatively narrow forward end at which the nozzle is located, and with a flap valve immediately behind the nozzle. This simple arrangement is effective, but convenience of use is limited by the fixed relationship between the nozzle on the one hand and the elongated assembly formed by the cleaner body and dust cup on the other hand. Thus, when trying to clean horizontal surfaces at a high location or vertical surfaces near the floor, it can be very awkward for the user to properly align the nozzle for effective cleaning of the surface. Rather than pointing the cleaner in a downwardly tilted direction in order to properly align the nozzle, as is normally done, it would be far more convenient in many instances (say when the cleaner is being used on a horizontal surface near the eye level of the user) to manipulate the cleaner while holding it in a horizontal attitude if proper nozzle alignment could be maintained.

Hand held vacuum devices have been proposed which are provided with flexible but positionally stable tubular connection of small cross sectional area between the collecting receptacle and a separate nozzle, as in U.S. Pat. No. 4,175,352, which is not of the type employing a separable dust cup, and is employed for insect collection rather than vacuum cleaning. However, no practical nozzle tilting arrangement with adequate cross section area has been developed for hand held vacuum cleaners of the dust cup type, even for those of the older constructions which had a separate nozzle. Constraints as to length of the cup-to-nozzle connection and minimal cross-sectional area for adequate vacuuming action make the use of a flexible but positionally stable tube impractical. And for dust cup type cleaners of the newer construction, in which the nozzle is located at the upstream end of the dust cup itself, there are not believed to have been any suggestions whatsoever regarding provision of a tilt nozzle or practical means to accomplish the same.

SUMMARY OF THE INVENTION

The present invention provides a tilt nozzle for hand held cleaners of the dust cup type, and particularly for such cleaners of the newer construction in which the nozzle is located at the upstream end of the dust cup itself. The body of the tilting nozzle projects from a cup mouth at the front end of the cup and is retained and rotatably carried by means within the cup for rotation between different angular positions. The downwardly tapering top wall of the dust cup terminates forwardly of the bottom wall so that the cup mouth leans forwardly, and the nozzle also leans forwardly at a similar angle when its bottom is parallel to the dust cup member.

A feature of the invention is the means for retaining and rotatably carrying the nozzle body. This means includes a unitary bearing body within the front end of the dust cup. The bearing body rotatably cradles the nozzle body and itself defines a valving mouth covered by a valving flap. The bearing body retains the nozzle body from the interior of the cup, and the nozzle body is retained from the exterior of the cup by retainer means on the sides of the nozzle that rotatably engage corresponding sides of the cup or cup mouth.

The nozzle may be stabilized in raised or tilted position by detent means which are actuated from the exterior of the dust cup.

The nozzle is adapted to the use of accessory tools which can be easily connected and removed. The provision of the tilt nozzle makes it practical to use such tools with a hand held cleaner.

The objects and advantages of the invention will become more fully apparent from the following more detailed description.

DETAILED DESCRIPTION OF THE DRAWINGS

Figure 1:
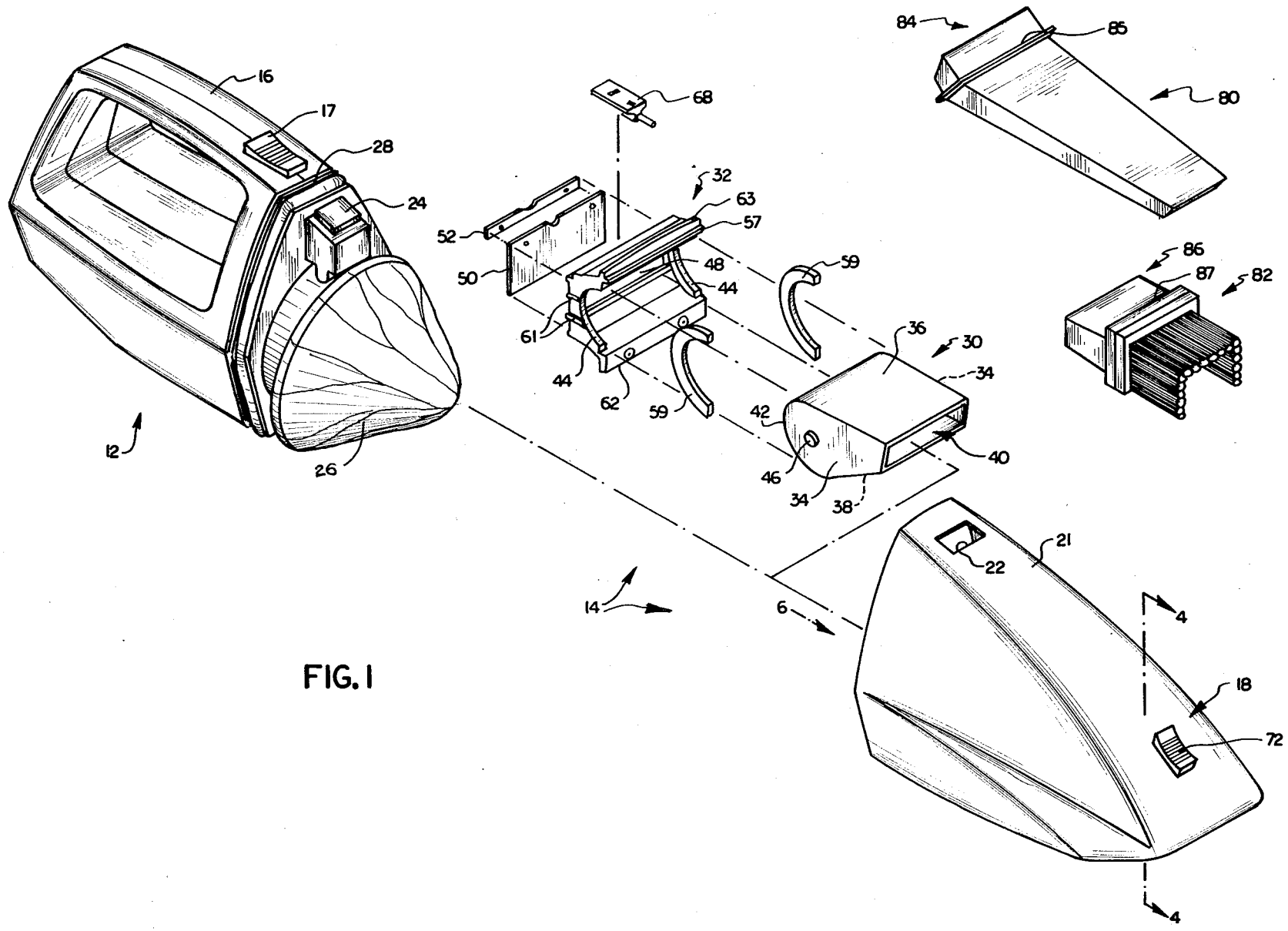
FIG. 1 is an isometric exploded view of a hand held vacuum cleaner embodying the invention, together with two attachments.

In the following description, the figure or figures in which a reference numeral appears may be indicated in parentheses immediately following the reference numeral.

The illustrated hand held vacuum cleaner is generally indicated by the reference numeral 10 (2,3). The cleaner 10 comprises first and second units 12 and 14 (1–3). The first unit 12 includes a motor (not shown), fan (not shown), handle 16 and power switch 17. The second unit includes a hollow dust receiving cup 18 (1–8) having a cup mouth 20 (2–5, 7) at its front end. The cup 18 has a window 22 (1) designed to receive depressable latch button 24 (1–3). The cup 18 also has another window (not shown) on its rear bottom edge below the window 22. Such additional window engages over a fixed boss (not shown) on the forward bottom edge of the first unit 12. To attach the dust cup, this latter engagement is first made to establish a hinging relation between the two units 12 and 14. The top rear edge of unit 14 is then hinged back toward unit 12 until it engages, depresses, and then passes latch button 24 which springs up into window 22 to lock the dust cup 18 into place.

A porous, removable filter bag 26 (1) covers the intake of the fan in a well known manner and filters dust out of the air drawn through the cleaner, thereby tapping the dust within the dust cup 18 in a well known manner. Exhaust air is vented from the first unit 12 through suitable openings (not shown). From time to time the cup 18 is detached from the first unit 12 to allow removal and cleaning or replacement of the filter bag and emptying of the dust cup through its large open rearward or downstream end, as is conventional. When the dust cup 18 is reassembled to the first unit 12, such end of the dust cup engages over a suitable peripheral O-ring 28 (1) or other seal on the first unit 12 to thereby prevent leakage of air and dust past the joint between the two assembled units 12 and 14, as is also conventional.

According to the present invention, the cup mouth 20 is adapted to have a nozzle body 30 (1–5, 7, 11, 12) projecting therefrom. A unitary bearing body 32 (1, 3, 4, 6) is fixed within the front end of the dust cup behind the cup mouth 20 and extends between the side walls and the top and bottom walls of the cup.

The nozzle body 30 has opposed side walls 34 (1–5, 7, 11, 12) and top and bottom walls 36 and 38 (1–5, 11, 12) respectively. The top and bottom walls each extend from one side wall to the other. These four walls define a nozzle intake mouth 40 (1–5) at the forward end of the nozzle body. The side walls 34 extend rearwardly from the nozzle intake mouth 40 and terminate in a pair of semi-circular lobes 42 (1, 4, 5). The top and bottom walls each extend straightly and rearwardly from the intake mouth 40 along the nozzle side walls 34 and then partially around the semi-circular lobes 42.

Figure 2:
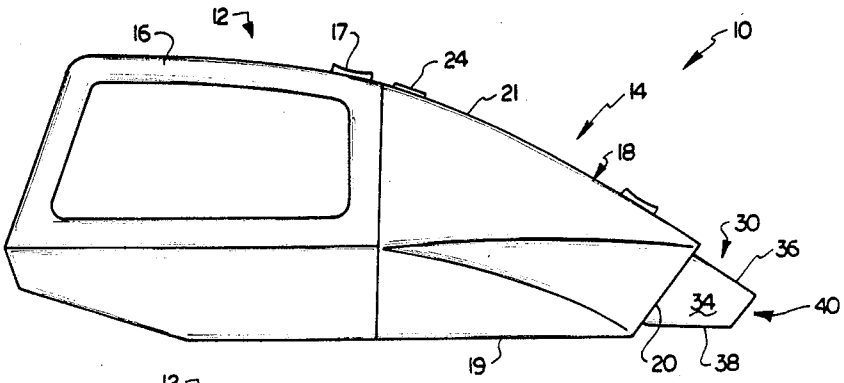
FIGS. 2 and 3 are side elevations of the cleaner shown in FIG. 1 showing the intake nozzle in different positions.
Figure 3:
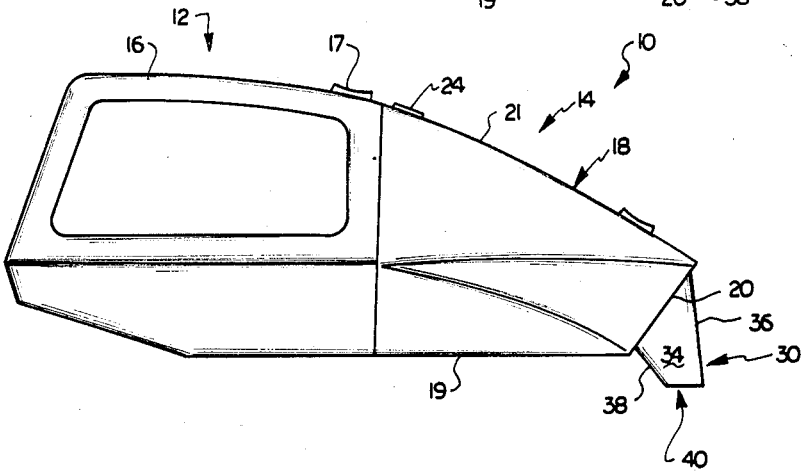

The cup 14 has a bottom wall 19 (2, 3) which extends straightly in the forward direction, although it may be dished slightly from side to side. The cup has a top wall 21 (1–3) which tapers toward the bottom wall in the forward direction and terminates forwardly of the bottom wall, whereby the cup mouth leans forwardly as best seen in FIGS. 2 and 3. The top wall 21 may also be slightly arcuate as well as slightly crowned from side to side. The side walls of the cup may be dished and fluted as shown.

As seen in FIG. 2, the nozzle mouth 40 leans forwardly at a leaning angle similar to that of the cup mouth 20 when the nozzle body 30 is at a position where a major portion of its bottom wall 38 is parallel to the straight bottom 19 of the dust cup 18. This is the fully raised position of the nozzle body 30 shown in FIGS. 2 and 4. In this position the nozzle body is stopped against further upward rotation by engagement of the nozzle body top wall 36 against the top side of the cup mouth 20. In the opposite fully lowered position of the nozzle body seen in FIGS. 3 and 5, further downward rotation is stopped by engagement of the nozzle body bottom wall against the bottom side of the cup mouth 20.

The unitary bearing body 32 includes arcuate surfaces 44 which rotatably cradle the lobes 42 and thereby act as bearings for the nozzle body 30 and also retain the nozzle body 30 from the interior of the cup 18. The side walls 34 of the nozzle body are provided with exterior arcuate-sided studs 46 (1, 4, 5, 7) which project from the side walls at the arcuate centers of the lobes 42 and rotatably engage corresponding sides of the cup mouth 20. The studs 46 act as retainer means and such engagement retains the nozzle body 30 from the exterior of the cup 18. When the parts are assembled, the arcuate surfaces 44 and the arcuate surfaces of the studs 46 are all centered on an imaginary axis "A" (4, 5, 7) near the front of the bearing body 32 and immediately within the cup mouth 20.

A valving mouth 48 (1, 4, 5) is formed in the bearing body 32. A valving flap 50 (1, 4–6) is positioned over the mouth 48 and normally closes off the interior of the dust cup. The flap 50 is anchored by retainer strip 52 which, together with the flap, is received on pins 54 (4–6) integrally extending from the unitary bearing body 32.

The sides of the unitary bearing body 32 are sealingly engaged with the dished and fluted side walls of the dust cup 18 by means of sealing cushions 59 (1, 6) of foam material adhered to the sides of body 32. The cushions 59 may cover small ribs or tabs 61 (1) formed in the sides of body 32 and which help to support the cushions for effective sealing.

Figure 6:
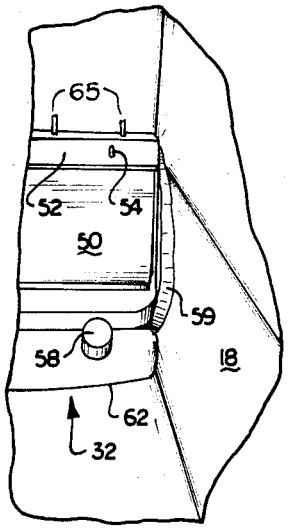
FIG. 6 is a fragmentary view from the direction of arrow 6 in FIG. 1, but after assembly of the illustrated nozzle components into the illustrated dust cup.
Figure 11:
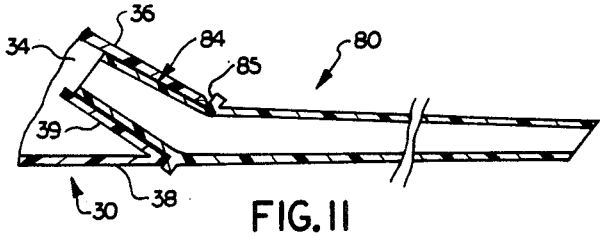
FIGS. 11 and 12 are fragmentary sectional views showing the two attachments illustrated in FIG. 1 inserted in the intake nozzle.
Figure 12:
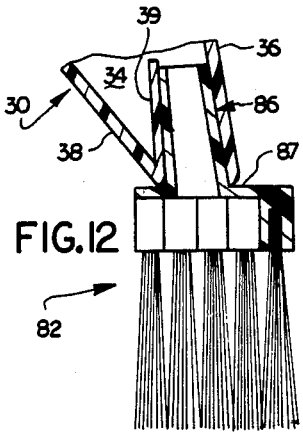
Figure 4:
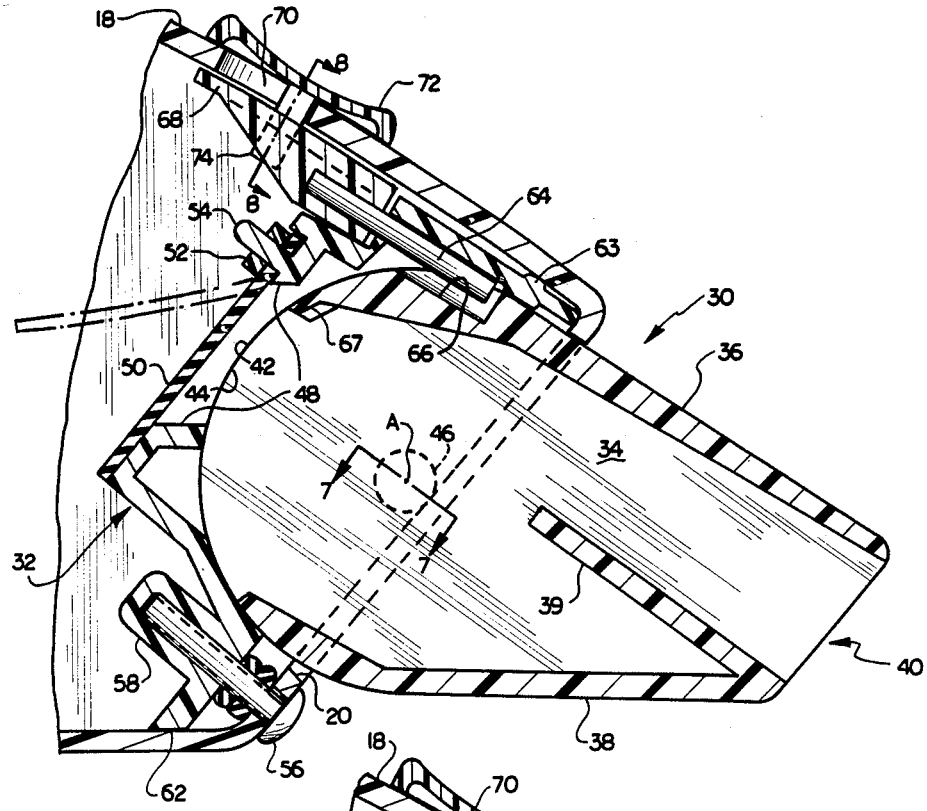
FIGS. 4 and 5 are enlarged fragmentary sections taken on plane 4—4 of FIG. 1, showing the same two positions of the intake nozzle.
Figure 5:
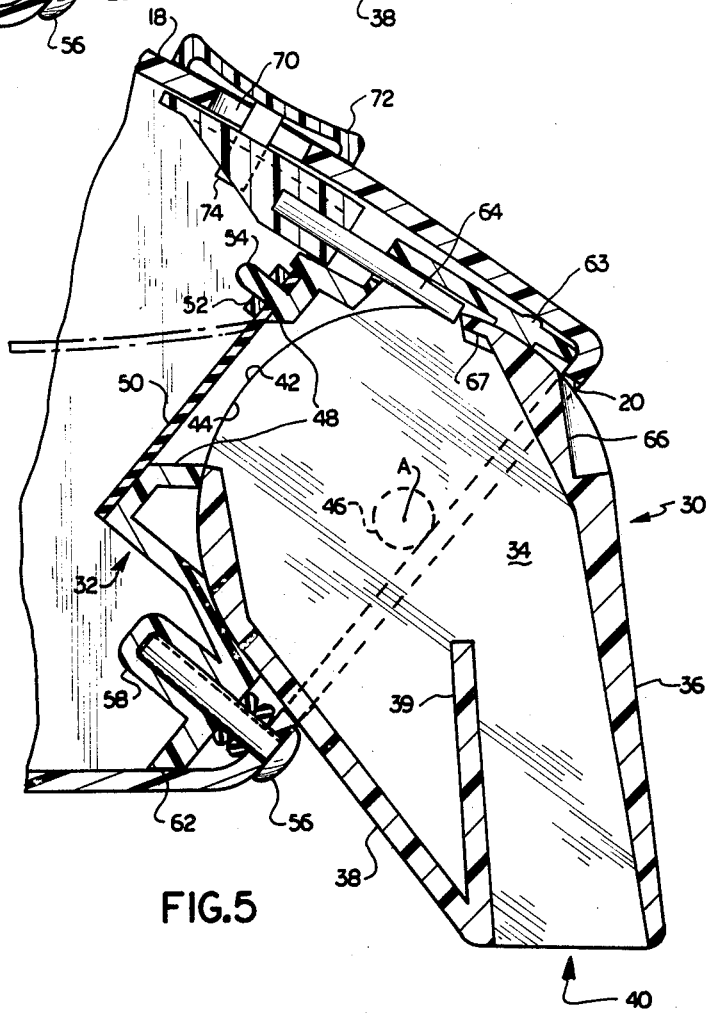

The bottom edge 62 (1, 4–6) of the unitary bearing body 32 directly seals against the bottom wall of the dust cup, and may be arcuately shaped to match, as best seen in FIG. 6. The top of the unitary bearing body is provided with an arcuate rib 63 (1, 4, 5) which matches the dished top wall 21 of the dust cup. The forward edge 57 (1) of the body 32 may also engage against the top side of the cup mouth 20, as seen in FIGS. 4 and 5. Spacer ribs 65 (6), not shown in FIGS. 4 and 5, may extend downwardly from the top wall 21 to brace rearward portions of the top of the bearing body 32.

The unitary bearing body 32 may be fastened in assembled position by screws 56 (4, 5) threaded into bosses 58 (4–6). Suitable spacer washers may be provided which may be separate elements as shown in the drawings, but which are preferably molded as integral parts of the body.

The nozzle body 30 is provided with detent means for locking the body in relative position. A slide pin 64 (4, 5, 9, 10) within the dust cup projects forwardly in generally parallel spaced relationship with the top wall of the dust cup. The pin is movable forwardly and rearwardly into and out of interference with a detent surface 66 (4, 5) notched into the nozzle body 30. (The clearance between the slide pin 64 and the surface 66 is exaggerated in FIG. 4). In the interfering position shown in FIG. 4, the nozzle is locked in the raised position.

Figure 8:
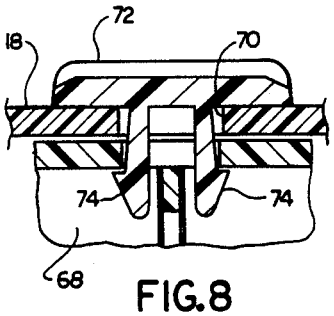
FIG. 8 is a fragmentary section taken on the plane 8—8 in FIG. 4.
Figure 7:
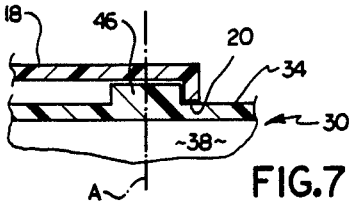
FIG. 7 is a fragmentary section taken on plane 7—7 in FIG. 4.

The pin 64 is fixed to a slide pedestal 68 (4, 5, 8–10) which slides on the inside of the top wall 18 of the dust cup over a straight-sided opening 70 (4, 5, 8) formed in the wall. A lock button 72 (1, 4, 5, 8) slides on the outside of the wall 18 in covering relationship with the opening 70. A pair of resilient prongs 74 (4, 5, 8) are integral with the lock button and extend through the opening 70 into interlocked engagement with the slide pedestal, as best seen in FIG. 8. As best seen in FIGS. 4 and 5, the slide pin 64 moves back and forth through a suitable opening at the upper center of the unitary bearing body 32. This opening may help guide the slide pin and hence the slide pedestal and lock button, but the pedestal and button are also guided in their sliding movement at least partly by sliding engagement of the resilient prongs with the straight sides of the opening 70.

Figure 9:
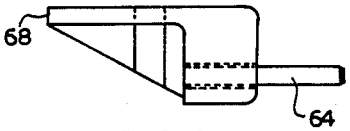
FIG. 9 is a side elevation of the slide pin and pedestal used to latch the nozzle.
Figure 10:
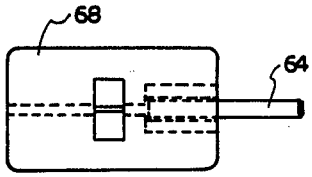
FIG. 10 is a top elevation of the structure seen in FIG. 9.

It will be noted in FIG. 5 that the button 72 and pin 64 are only partly advanced, as compared to the fully advanced position seen in FIG. 4. This is because with the particular vertical dimension of pedestal 68 that is shown in these figures, advance of the pin is limited by engagement with a central tab which is grooved to form a detent surface 67 (4, 5) at the center rear of the nozzle body top wall 36. However if the vertical dimension of pedestal 68 is somewhat greater, as in FIG. 9, so as to somewhat increase the spacing of pin 64 from the wall 18, and the adjacent parts of unitary bearing body 32 are correspondingly changed (repositioned slightly farther from wall 18) to make room for such greater vertical dimension of pedestal 68, then when the nozzle is down, the pin 64 can be advanced over the tab edge and into engagement along detent surface 67 at the underside of the tab. With the parts in such position, the nozzle is locked in its down position.

As best seen in FIGS. 4 and 5, in the fully raised position of the nozzle body 30 it is stopped against further upward rotation by engagement of its top wall against the top side of the cup mouth 20, and in its fully lowered position the nozzle body is stopped against further downward rotation by engagement of its bottom wall against the bottom side of the cup mouth.

The nozzle body 30 has an internal wall 39 (4, 5, 11, 12) extending in at least approximate parallelism to the nozzle top wall 36 and rearwardly from the bottom side of the nozzle intake mouth 40 to an intermediately rearward point within the nozzle body.

Auxiliary tool means are provided including a crevice tool 80 (1, 16) and a brush 82 (1, 12). The tools 80 and 82 respectively have outflow connections 84 and 86, each receivable in the nozzle intake mouth 40. Each of the outflow connections includes outflow side walls slidably insertable into the nozzle mouth and engageable along and within the side walls 34, and also includes outflow top or bottom wall means slidably insertable into the nozzle mouth and engageable along and within respectively the top wall 36 or internal wall 39. The outflow connections 84 and 86 are respectively provided with stops 85 and 87.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A hand held vacuum cleaner comprising a first unit including motor, fan and handle and a second unit projecting in front of the first unit and including a hollow dust-receiving cup having a cup mouth at its front end, a nozzle body projecting from the cup mouth and rotatably carried by means within the cup for rotation between different angular positions, said nozzle body substantially filling said cup mouth in all said angular positions, said nozzle body having side, top and bottom walls and defining a nozzle intake mouth at its forward end, said cup having a bottom wall which extends straightly in the forward direction and a top wall tapering toward said bottom wall in the forward direction and terminating forwardly of said bottom wall whereby said cup mouth leans forwardly, said nozzle mouth also leaning forwardly at a leaning angle similar to that of said forwardly leaning cup mouth when said nozzle body is at a position where a major portion of its bottom is parallel to the straight bottom of the dust cup.

2. A device as in claim 1, said last named position being the fully raised position of said nozzle body.

3. A device as in claim 1, said nozzle body having an internal wall extending in at least approximate parallelism to said nozzle top wall and rearwardly from the bottom side of said nozzle intake mouth to an intermediately rearward point within said nozzle body.

4. A device as in claim 3, auxilary tool means having outflow connections receivable in said nozzle intake mouth.

5. A device as in claim 4, said outflow connections comprising outflow side walls slidably insertable into said nozzle mouth and engageable along and within said side walls of said nozzle body, and also comprising outflow top or bottom wall means slidably insertable into said nozzle mouth and engageable along and within respectively said top or internal wall of said nozzle body.

6. In a hand held vacuum cleaner comprising a first unit including motor, fan and handle and a second unit projecting in front of the first unit and including a hollow dust-receiving cup having a cup mouth at its front end, tiltable nozzle means comprising a unitary bearing body within the front end of the dust cup behind said cup mouth and extending between the side walls and the top and bottom walls of the cup, a nozzle body projecting from the cup mouth and rotatably cradled in cradling means formed in the bearing body, said cradling means being internal to the cup and external to the nozzle body, said nozzle body being retained from the interior of the cup by said cradling means, said nozzle body substantially filling said cup mouth in all said angular orientations, retainer means on the sides of the nozzle body and rotatably engaging corresponding sides of the cup or cup mouth, the nozzle body being retained from the exterior of the cup by said engagement.

7. A device as in claim 6, a valving mouth formed in said bearing body, a valving flap over said valving mouth and normally closing off the interior of the dust cup.

8. A device as in claim 6, said nozzle body having an imaginary axis of rotation extending from side to side of said cup near the front of said bearing body and immediately within said cup mouth.

9. A device as in claim 8, said nozzle body having side, top and bottom walls and defining a nozzle intake mouth at its forward end, the side walls of said nozzle body extending rearwardly from said nozzle intake mouth and terminating in a pair of semi-circular lobes, said nozzle body having an internal wall extending in at least approximate parallelism to said nozzle top wall and rearwardly from the bottom side of said nozzle intake mouth to an intermediately rearward point within said nozzle body.

10. A device as in claim 8, said nozzle body having side, top and bottom walls and defining a nozzle intake mouth at its forward end, the side walls of said nozzle body extending rearwardly from said nozzle intake mouth and terminating in a pair of semi-circular lobes engaging said cradling means.

11. A device as in claim 10, said retainer means on the sides of the nozzle body comprising arcuate-sided studs projecting from the side walls of said nozzle body at the arcuate centers of said lobes.

12. A device as in claim 11, the top and bottom walls of said nozzle body each extending from one of said nozzle side walls to the other and also extending straightly and rearwardly from said intake nozzle mouth along said nozzle side walls and then partially around said semi-circular lobes, said top and bottom walls of said nozzle body being spaced from each other to define, along with said semi-circular lobes, a nozzle outlet mouth of greater cross-sectional area than the nozzle inlet mouth.

13. A hand held vacuum cleaner comprising a first unit including motor, fan and handle and a second unit projecting in front of the first unit and including a hollow dust-receiving cup having a cup mouth at its front end, tiltable nozzle means comprising a nozzle body projecting from the cup mouth and rotatably carried by means within the cup for rotation between different angular positions, said nozzle body substantially filling said cup mouth in all said angular positions, said nozzle body having side, top and bottom walls and defining a nozzle intake mouth at its forward end.

14. A device as in claim 13, said nozzle body being rotatably movable between a fully raised position at which the nozzle body is stopped against further upward rotation by engagement of the nozzle body top wall against the top side of said cup mouth and a fully lowered position at which the nozzle body is stopped against further downward rotation by engagement of the nozzle body bottom wall against the bottom side of the cup mouth.

15. A device as in claim 13, said nozzle body having detent means for locking said nozzle body in at least one angular position.

16. A device as in claim 15, said detent means comprising a slide pin within said dust cup and projecting forwardly in spaced generally parallel relationship with one wall of said dust cup, said pin being movable forwardly and rearwardly into and out of interference with a surface formed on said nozzle body.

17. A device as in claim 16, said pin being mounted on a slide pedestal which slides on the inside of said one wall of the dust cup and across an opening formed in said wall.

18. A device as in claim 17, a lock button sliding on the outside of said one wall in covering relationship with said opening.

19. A device as in claim 18, resilient prong means integral with the lock button and extending through said opening into interlocked engagement with said slide pedestal.

20. A device as in claim 19, said slide pedestal and lock button being at least partly guided in their sliding movement by sliding engagement of said resilient prong means with the straight sides formed along said opening.

21. A device as in claim 1, said nozzle projecting below said straight bottom of the dust cup when said nozzle is in its fully lowered position.

22. A device as in claim 1, said nozzle mouth being substantially parallel to said straight bottom of the dust cup when said nozzle is in its fully lowered position.

* * * * *